United States Patent [19]

Hermanns

[11] Patent Number: 4,696,435

[45] Date of Patent: Sep. 29, 1987

[54] METHOD AND DEVICE FOR AVOIDING THE FORMATION OF IRREGULAR TURNS DURING THE WINDING OF A CROSS-WOUND COIL

[75] Inventor: Ferdinand-Josef Hermanns, Erkelenz, Fed. Rep. of Germany

[73] Assignee: W. Schlafhorst & Co., Moenchen-Gladbach, Fed. Rep. of Germany

[21] Appl. No.: 873,392

[22] Filed: Jun. 12, 1986

[30] Foreign Application Priority Data

Jun. 13, 1985 [DE] Fed. Rep. of Germany ..... 3521152

[51] Int. Cl.[4] ..... B65H 54/38

[52] U.S. Cl. ..... 242/18.1

[58] Field of Search ..... 242/18.1, 18 DD, 18 R, 242/43 R, 43.2, 45, 36

[56] References Cited

U.S. PATENT DOCUMENTS

| | | | |
|---|---|---|---|
| 1,946,506 | 2/1934 | Swanson et al. | 242/18.1 |
| 2,036,441 | 4/1936 | Swanson | 242/18.1 |
| 2,066,494 | 1/1937 | Swanson | 242/18.1 |
| 4,049,211 | 9/1977 | Spescha | 242/18.1 X |
| 4,060,208 | 11/1977 | Raasch | 242/18.1 |
| 4,487,374 | 12/1984 | Sugioka et al. | 242/18.1 X |
| 4,565,332 | 1/1986 | Slaghuis et al. | 242/18.1 |

*Primary Examiner*—Stanley N. Gilreath

*Attorney, Agent, or Firm*—Herbert L. Lerner; Laurence A. Greenberg

[57] ABSTRACT

Method of avoiding the formation of irregular thread turns during the winding of a cross-wound coil driven by a drive drum formed with reversing thread grooves cooperating with a thread guide, a rotating element connectible to the cross-wound coil being braked with a varying braking force, which comprises the steps of continuously varying the peripheral velocity of the drive drum, and simultaneously braking, at least one of the cross-wound coil and the rotating element connected thereto, with a variable braking force in such manner that the peripheral velocity of the cross-wound coil remains constant within given tolerance limits.

10 Claims, 2 Drawing Figures

METHOD AND DEVICE FOR AVOIDING THE FORMATION OF IRREGULAR TURNS DURING THE WINDING OF A CROSS-WOUND COIL

The invention relates to a method and a device for avoiding the formation of irregular turns during the winding of a cross-wound coil, which is driven by a drive drum formed with reversing thread grooves serving as thread guides, a rotating element connected to the cross-wound coil being braked with varying braking force.

Methods and devices of this general type seek to prevent the formation, from time to time during the winding operation and within given diameter ranges, of irregular turns i.e. turns which are disposed tightly close to or on top of one another on the peripheral surface of the coil.

It has become known heretofore to provide a friction drive for the cross-wound coil with a drive drum which is intermittently brought into contact with a drive shaft by a periodically inwardly swinging friction roller. After an interruption of the drive, when the friction roller has swung inwardly again, slippage occurs between the cross-wound coil and the drive drum, by means of which an irregular turn which is formed should be broken down and loosened. No perfect way of disrupting such irregular turns has proved successful by this heretofore known method.

It has also become known heretofore to brake with variable braking force a rotating element which is connected to the cross-wound coil. The braking force can be so adjusted and varied that continuous slippage of varying degree occurs between the cross-wound coil and the drive drum. For this purpose, the rotating element is brought into contact with a brake which is operatively connected to a controllable brake-force adjusting device, which enables the transmission of continuously changing brake forces.

Because the cross-wound coil thus rotates with a continuously varying rotational speed, difficulties arise as the coil diameter increases, especially for coils having considerable mass. The brake heats up, drive energy is lost, adjustment of the brake forces with increasing coil size presents difficulties, and the life of the brake is diminished.

It is accordingly an object of the invention to provide a method and device for avoiding the formation of irregular turns during the winding of a cross-wound coil which avoid the foregoing difficulties and which achieve an effective disruption of such irregular turns with minimum expenditure of brake energy and at low expense.

With the foregoing and other objects in view, there is provided, in accordance with the invention, a method of avoiding the formation of irregular thread turns during the winding of a cross-wound coil driven by a drive drum formed with reversing thread grooves cooperating with a thread guide, a rotating element connectible to the cross-wound coil being braked with a varying braking force, which comprises the steps of continuously varying the peripheral velocity of the drive drum, and simultaneously braking, at least one of the cross-wound coil and the rotating element connected thereto, with a variable braking force in such manner that the peripheral velocity of th cross-wound coil remains constant within given tolerance limits. The mean peripheral velocity of the drive drum is thereby greater than the mean peripheral velocity of the cross-wound coil.

Though it would be ideal to maintain the peripheral velocity of the coil constant, it is generally more practical economically not to require too much accuracy with respect to the constancy of the peripheral velocity.

In accordance with another feature of the invention, the steps include increasing the peripheral velocity of the drive drum at a point in time when the peripheral velocity of the cross-wound coil is constant or when the peripheral velocities of the cross-wound coils and the drive drum coincide, initiating the braking of the cross-wound coil at the latest when the peripheral velocity of the cross-wound coil then exceeds an upper tolerance limit, reducing the peripheral velocity of the drive drum until it falls below a given value, again increasing the peripheral velocity of the drive drum thereafter, and continuously repeating the preceding steps until the cross-wound coil is completely wound.

In accordance with a further feature of the invention, the steps include measuring the angular velocities of the cross-wound coils and the drive drum to determine the peripheral velocities from these measurements whereby, at the beginning of each operating cycle, at the point in time when the angular velocity of the cross-wound coil is constant or the instant the increases of the angular acceleration of both rotating parts are approximately the same, both the instantaneous angular velocity of the cross-wound coil for the cross-wound coils as well as the angular velocity of the drive drum for the drive drum forms a unit of measure for the peripheral velocity of both rotating parts which is assumed at this instant of time to be of like value.

In accordance with an additional feature of the invention, the steps include storing at least the instantaneously angular velocity of the cross-wound coil in a computer or microprocessor at a point in time when the angular velocity of the cross-wound coil is constant or the instant the increases of the angular acceleration of both rotating parts are approximately the same, and then increasing the angular velocity of the drive drum while the computer or microprocessor actuates a coil braking device and controls the angular velocity of the cross-wound coil to the previously stored value; the instant the angular velocity of the drive drum has reached a variably predeterminable value, reducing the angular velocity of the dive drum until it falls below a given value at which the computer or microprocessor enables discontinuance of the braking by the coil braking device; again increasing the angular velocity of the drive drum; storing at least the angular velocity of the cross-wound coil in the computer or microprocessor the instant the angular velocity of the cross-wound coil is again constant or the instant the increases in the angular velocities of both rotating parts are approximately the same, and actuating the coil braking device anew to control the angular velocity of the cross-wound coil to the then newly stored value; and continuously repeating the preceding steps until the cross-wound coil is completely wound.

In accordance with another aspect of the invention, a device for performing there is provided, a method of avoiding the formation of irregular thread turns during the winding of a cross-wound coil driven by a drive drum formed with reversing thread grooves cooperating with a thread guide, comprising a driving device for the drive drum, and a pulse generator responsive to an angle of rotation of the drive drum; a coil braking device connectible to the cross-wound coil, and a pulse generator responsive to an angle of rotation of the cross-wound coil; a computer or microprocessor to which both said pulse generators are operatively connected; said computer or microprocessor being operatively connected to said driving device for controlling the rotary speed thereof, and to said coil braking device for controlling the braking force thereof.

In accordance with an added feature of the invention, the driving device is formed of an electric drive motor.

In accordance with yet another feature of the invention, the driving device is formed of a controllable rotary speed transducer located between a continuously rotating shaft and the drive drum.

In accordance with yet a further feature of the invention, the coil braking device is an electromagnetically driven brake having a brake current control device.

In accordance with yet an additional feature of the invention, the coil braking device is an electrically driven brake having a brake current control device.

In accordance with a concomitant feature of the invention, the coil braking device is a polyphase synchronous motor, and including a converter for supplying said motor, the converter being controllable by said computer or microprocessor. With respect to the electrically or electromagnetically actuated brake, the computer or microprocessor controls the braking current supplied thereto.

The converter is controlled in a conventional way. The converter supplies to the polyphase-asynchronous motor electrical energy of variable current strength, variable voltage and/or variable frequency.

Computers or microprocessors, asynchronous motors and converters are economical and operationally reliable components which contribute to the realization of the gist of the invention.

Other features which are considered as characteristic for the invention are set forth in the appended claims.

Although the invention is illustrated and described herein as embodied in method and device for avoiding the formation of irregular turns during the winding of a cross-wound coil, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
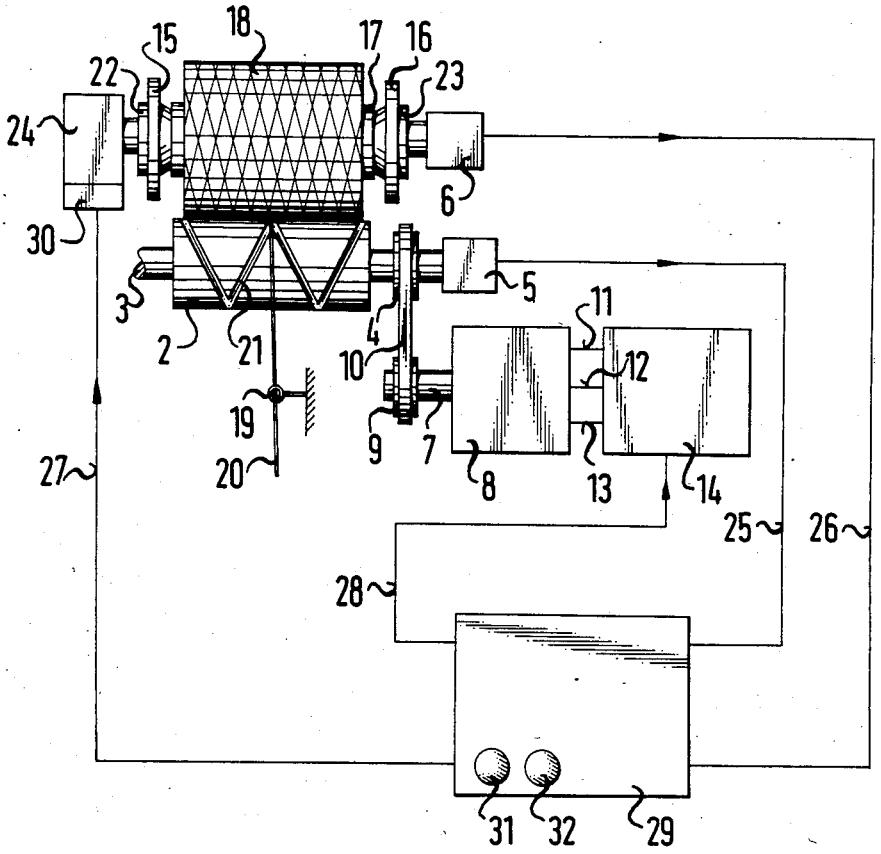
FIG. 1 is a block circuit diagram of a device for avoiding the formation of irregular windings during the winding of a cross-wound coil according to the invention.

Referring now to the drawing and, first, particularly to FIG. 1 thereof, there is shown in limited detail a winding station of an automatic winding machine 1. A drive-drum 2 having a stationary mounting is provided with a shaft 3, which carries a belt pulley 4. A pulse generator 5 is provided at the end of the shaft 3. Another belt pulley 9 is fastened to the shaft 7 of a polyphase-asynchronous motor 8. An endless drive belt 10 is looped around the belt pulleys 4 and 9. The polyphase-asynchronous motor 8 is connected by three feed lines 11, 12 and 13 to a converter 14. A pivotally mounted coil frame 15, 16 carries a tube sleeve 17 of a cross-wound coil or bobbin 18. The cross-wound coil 18 lies on the drive drum 2, and is driven due to friction by the drum 2. A thread 20 is fed to the cross-wound coil through a thread eye guide 19. Reversing thread grooves 21 formed in the drive drum 2 serve for guiding the thread.

Rotating elements 22 and 23 are mounted in the coil frame 15, 16 and have a conical form in a portion thereof extending towards the tube sleeve 17, so that they can accept sleeves having different diameters. Adjacent to the rotating element 22, a braking device is arranged in the form of an electrically actuatable brake 24. A pulse generator 6 is provided at the end of the rotating elements 23.

Both pulse generators 5 and 6 are responsive to the rotation angle. The pulse generator 5 has an operative connection 25 with a computer 29. The pulse generator 6 has an operative connection 26 with the same computer 29.

The brake 24 is provided with a brake current-control device 30, which is connected to the computer 29 by an operative connection 27. Through an additional operative connection 28, the converter 14 is controllable by the computer 29.

In this exemplary embodiment, the pulse generators 5 and 6 are supposed to issue four pulses for each revolution of the shaft 3, and the rotating element 23, respectively. The computer 29 contains two timing registers, which are triggered by the introduced pulses.

The device of the invention functions as follows:

It is assumed that the polyphase-asynchronous motor 8 is running and, consequently, that the drive drum 2 is rotating. In a first operating cycle at a point in time when the rises in angular velocity of the cross-wound coil 18 and of the drive drum 2 are approximately equal, as determined by the microprocessor 29 with the aid of the pulses coming from the pulse generators 5 and 6, the then existing angular velocity of the cross-wound coil 18 is stored in a memory provided in the computer 29. As a result, the angular velocity of the drive drum 2 is increased by the fact that the computer 29 enables the converter 14 via the operative connection 28 so that it supplies electrical energy with increasing frequency to the polyphase asynchronous motor through the feed lines 11, 12 and 13. Simultaneously, the computer 29 activates the coil brake 24 via the operative connection 27 and the brake current-control device 30, in order to control the angular velocity of the cross-wound coil 18 to the previously stored value. In this regard, small control deviations occur, but remain within predetermined tolerances, however.

The instant the angular velocity of the drive drum 2 has reached a variably predeterminable value, which can be set by a nominal value setting or adjusting device 31, the velocity is reduced again by the fact that the computer 29, via the operative connection 28, enables the converter 14 to deliver no electrical energy anymore to the polyphase asynchronous motor 8.

The angular velocity of the drive drum 2 then falls below a predetermined value, which can be set on another nominal value setting device 32. Up to this point, the brake device 24 remains active in order to permit the cross-wound coil 18 to rotate with the most uniform angular velocity.

The instant the angular velocity of the drive drum 2 falls below the value set on the nominal value setting device 32, however, the computer 29 disables the coil braking device 24. Thereafter, the angular velocity of the drive drum 2 is raised again by the fact that the computer 29 enables the converter 14, via the operative connection 28, to supply electrical energy with increasing frequency anew to the polyphase asynchronous motor 8.

Because the cross-wound coil 18 now rotates without any brake-action on the drive drum 2, its angular velocity is constant for a short time span during a transition of decreasing angular velocity of the drive drum 2 to an increasing angular velocity thereof, and from this instant on, the first operating cycle can be repeated. The repetition of the first operating cycle starts with again storing the angular velocity of the cross-wound coil in the memory of the computer of the computer 29. In the interim, the diameter of the cross-wound coil 18 has grown somewhat, so that the angular velocity in the second operating cycle is somewhat smaller than the angular velocity measured during the first operating cycle. The angular velocities are stored alternatingly, whenever the increases in the velocities of the two rotating parts are somewhat equal. The operating cycles are continually repeated until the cross-wound coil is completely wound.

Figure 2:
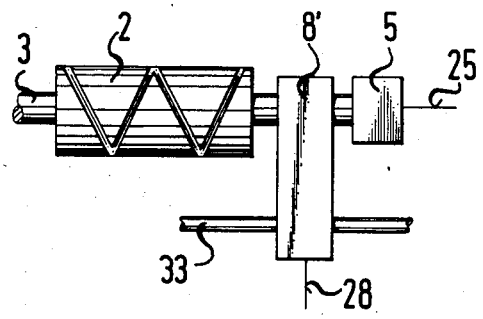
FIG. 2 is a fragmentary view of FIG. 1 showing another embodiment of the drive device thereof.

In the construction of the invention according to FIG. 2, the driving arrangement of the drive drum is formed of a rotary speed transducer 8' which is arranged between a continuously running shaft 33 and the drive drum 2.

The invention is not supposed to be limited to the illustrated and described embodiment. It can be of advantage to undertake the disruption of the irregular turn formation according to the invention only if the cross-wound coil actually passes through certain diameter ranges, in which irregular turns would form. It can also be of advantage to vary the amplitude of the change in the peripheral velocity of the cross-wound coil either continuously or intermittently.

It may also occur that the peripheral velocity of the drive drum for each disruption stroke applied to the formation of irregular turns is, in fact, quasi constant, but varies in long waves, the peripheral velocity of the cross-wound coil thereby undergoing long wave variations.

Alternatively, tachogenerators and direct-current motors can be used for performing the method. The angular velocity is determinable from the voltage output of the tachogenerator. The drive drum can be driven by a direct-current motor, which also provides a drive arrangement controllable to any desired fine stage. In an alternate arrangement, the drive drum can be mounted on the shaft of a drive motor.

There is claimed:

1. Method of avoiding the formation of irregular thread turns during the winding of a cross-wound coil driven by a drive drum formed with reversing thread grooves cooperating with a thread guide, a rotating element connectible to the cross-wound coil being braked with a varying braking force, which comprises the steps of continuously varying the peripheral velocity of the drive drum, and simultaneously braking, at least one of the cross-wound coil and the rotating element connected thereto, with a variable braking force in such manner that the peripheral velocity of the cross-wound coil remains constant within given tolerance limits.

2. Method according to claim 1 which includes the steps of increasing the peripheral velocity of the drive drum at a point in time when the peripheral velocity of the cross-wound coil is constant or when the peripheral velocities of the cross-wound coils and the drive drum coincide, initiating the braking of the cross-wound coil at the latest when the peripheral velocity of the cross-wound coil then exceeds an upper tolerance limit reducing the peripheral velocity of the drive drum until it falls below a given value, again increasing the peripheral velocity of the drive drum thereafter, and continually repeating the preceding steps until the cross-wound coil is completely wound.

3. Method according to claim 2 which includes the steps of measuring the angular velocities of the cross-wound coils and the drive drum to determine the peripheral velocities from these measurements whereby, at the beginning of each operating cycle, at the point in time when the angular velocity of the cross-wound coil is constant or the instant the increases of the angular acceleration of both rotating parts are approximately the same, both the instantaneous angular velocity of the cross-wound coil for the cross-wound coils as well as the angular velocity of the drive drum for the drive drum forms a unit of measure for the peripheral velocity of both rotating parts which is assumed at this instant of time to be of like value.

4. Method according to claim 3 which includes the steps of storing at least the instantaneously angular velocity of the cross-wound coil in a computer or microprocessor at a point in time when the angular velocity of the cross-wound coil is constant or the instant the increases of the angular acceleration of both rotating parts are approximately the same, and then increasing the angular velocity of the drive drum while the computer or microprocessor actuates a coil braking device and controls the angular velocity of the cross-wound coil to the previously stored value; the instant the angular velocity of the drive drum has reached a variably predeterminable value, reducing the angular velocity of the dive drum until it falls below a given value at which the computer or microprocessor enables discontinuance of the braking by the coil braking device; again increasing the angular velocity of the drive drum; storing at least the angular velocity of the cross-wound coil in the computer or microprocessor the instant the angular velocity of the cross-wound coil is again constant or the instant the increases in the angular velocities of both rotating parts are approximately the same, and actuating the coil braking device anew to control the angular velocity of the cross-wound coil to the then newly stored value; and continually repeating the preceding steps until the cross-wound coil is completely wound.

5. Device for performing a method of avoiding the formation of irregular thread turns during the winding of a cross-wound coil driven by a drive drum formed with reversing thread grooves cooperating with a thread guide, comprising a driving device for the drive drum, and a pulse generator responsive to an angle of rotation of the drive drum; a coil braking device connectible to the cross-wound coil, and a pulse generator responsive to an angle of rotation of the cross-wound coil; a computer or microprocessor to which both said pulse generators are operatively connected; said computer or microprocessor being operatively connected to said driving device for controlling the rotary speed thereof, and to said coil braking device for controlling the braking force thereof.

6. Device according to claim 5 wherein said driving device is formed of an electric drive motor.

7. Device according to claim 5 wherein said driving device is formed of a controllable rotary speed transducer located between a continuously rotating shaft and the drive drum.

8. Device according to claim 5 wherein said coil braking device is an electromagnetically driven brake having a brake current control device.

9. Device according to claim 5 wherein said coil braking device is an electrically driven brake having a brake current control device.

10. Device according to claim 5 wherein said coil braking device is a polyphase synchronous motor, and including a converter for supplying said motor, said converter being controllable by said computer or microprocessor.

* * * * *